United States Patent [19]

Mirisch, Sr.

[11] Patent Number: 4,937,107

[45] Date of Patent: Jun. 26, 1990

[54] CHRISTMAS TREE DECORATION

[76] Inventor: Kurt E. Mirisch, Sr., 11279 Caves Rd., Chesterland, Ohio 44026

[21] Appl. No.: 373,926

[22] Filed: Jun. 29, 1989

[51] Int. Cl.[5] ..... A47G 33/06; B44C 5/04

[52] U.S. Cl. ..... 428/7; D11/118; 362/123; 428/18; 493/956

[58] Field of Search ..... D11/118; 362/123; 493/956, 957, 958; 428/7, 10, 18, 19, 20

[56] References Cited

U.S. PATENT DOCUMENTS

| | | | |
|---|---|---|---|
| 1,764,540 | 6/1930 | Vydra | D11/118 X |
| 2,242,597 | 5/1941 | Quandee | 428/18 X |
| 3,027,671 | 4/1962 | Duvall | 428/18 X |
| 3,544,783 | 12/1970 | Williams, Sr. | 428/20 X |
| 3,676,275 | 7/1972 | Sloane | 428/19 X |
| 3,857,748 | 12/1974 | Thomann | D11/118 X |
| 4,537,806 | 8/1985 | Sherrard | 428/7 |
| 4,657,800 | 4/1987 | Long | 428/18 X |

*Primary Examiner*—Henry F. Epstein
*Attorney, Agent, or Firm*—Pearne, Gordon, McCoy & Granger

[57] ABSTRACT

A decorative wall hanging includes a molded, substantially rigid shell formed of plastic material, the shell being shaped to provide a simulated Christmas tree portion with an ornament on the top and a base on the lower end. The shell provides a forward face covered by a simulated pine garland to simulate a Christmas tree appearance. The shell provides a plurality of randomly located openings surrounded by generally cylindrical bores. A string of electric lights is mounted on the shell with sockets supported and adhesively secured in the bores. The bulbs project from the sockets forwardly of the bores and are at least partially covered by the garland so that the light from the bulbs is diffused. The ornaments can be tested for compact shipment and storage. For larger wall ornaments, the shell can be assembled in more than one piece.

9 Claims, 4 Drawing Sheets

Fig. 3
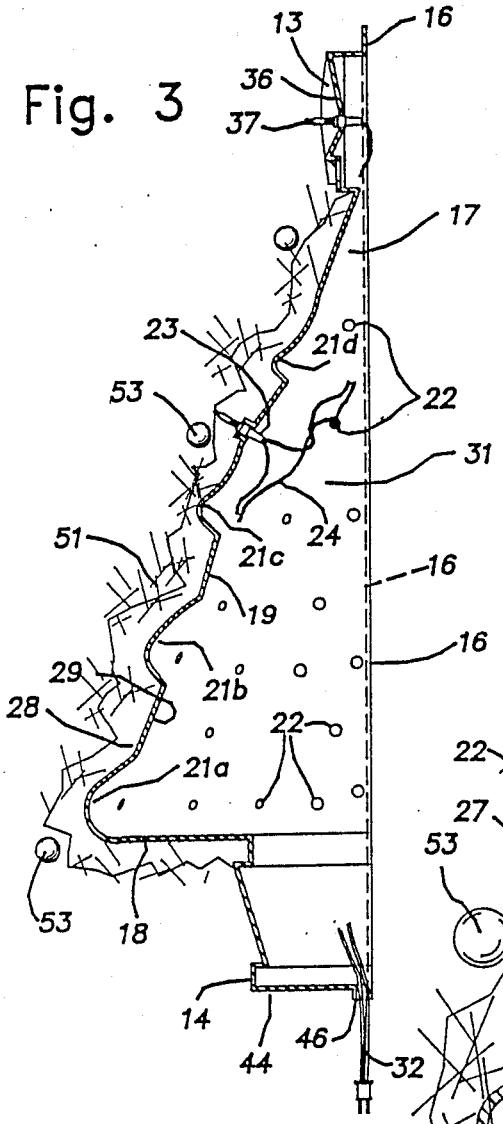
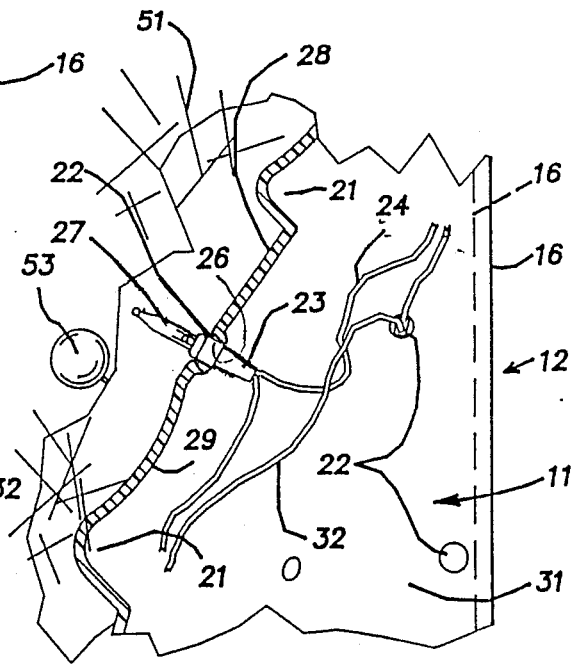
Fig. 4

CHRISTMAS TREE DECORATION

BACKGROUND OF THE INVENTION

This invention relates generally to decorative wall hangings and the like and more particularly to a novel and improved lighted ornamental wall hanging such as a simulated Christmas tree.

PRIOR ART

Various types of decorative wall hanging are known, some of which include lights. In some instances, they provide molded plastic shell for shape.

SUMMARY OF THE INVENTION

The present invention is directed to a novel and improved lighted decoration particularly suited for use as a wall hanging which can be reliably produced at moderate cost, which is durable, and which can be nested for compact shipment and storage. The decoration includes a molded relatively thin shell shaped to provide a three dimensional unit. The illustrated embodiment is shaped to represent a Christmas tree having a top ornament and a lower base. The shell provides a forward or outer face and a concave rearward face defining a rearward cavity.

Secured to the outer face is decorative material. In the illustrated embodiment, a garland-type rope is attached by adhesive to cover the entire forward face of the simulated tree portion of the shell. This gives the appearance of the needles of a Christmas tree.

The shell is formed with openings in which sockets of a string of electric Christmas lights are mounted. The wire of the string of lights extends along and is concealed within the rearward cavity. The sockets are positioned so that the light bulbs themselves extend forwardly from the front face. In the illustrated embodiment the garland partially covers the light bulb so the light from the bulb is diffused through the garland to some extent.

The openings for the sockets are formed with a generally cylindrical bore extending substantially perpendicular to the adjacent wall portion of the shell. Such bores provide a surface enclosing and supporting a substantial portion of the socket. In the illustrated embodiment, adhesive is provided to assist in anchoring the sockets in the associated bores.

The illustrated embodiment is also provided with a relatively narrow contrasting roping and small ornaments so that the overall appearance of the decoration simulates an attractively decorated Christmas tree. Such ornaments are usually hung on the wall but, if desired, two such ornaments may be connected together back-to-back to provide a simulation of an entire tree which can be suspended away from the wall.

Because the ornament is concave on one side, several ornaments can be nested for shipment and storage in a compact manner. These and other aspects of this invention are illustrated in the accompanying drawings and are more fully described in the following specification.

BRIEF DESCRIPTION OF THE DRAWINGS

FIG. 3 is a cross-section taken along line 3—3 of FIG. 1 with a portion of the string of lights removed;

FIG. 4 is an enlarged, fragmentary section illustrating the mounting of the light sockets;

DETAILED DESCRIPTION OF THE DRAWINGS

Figure 1:
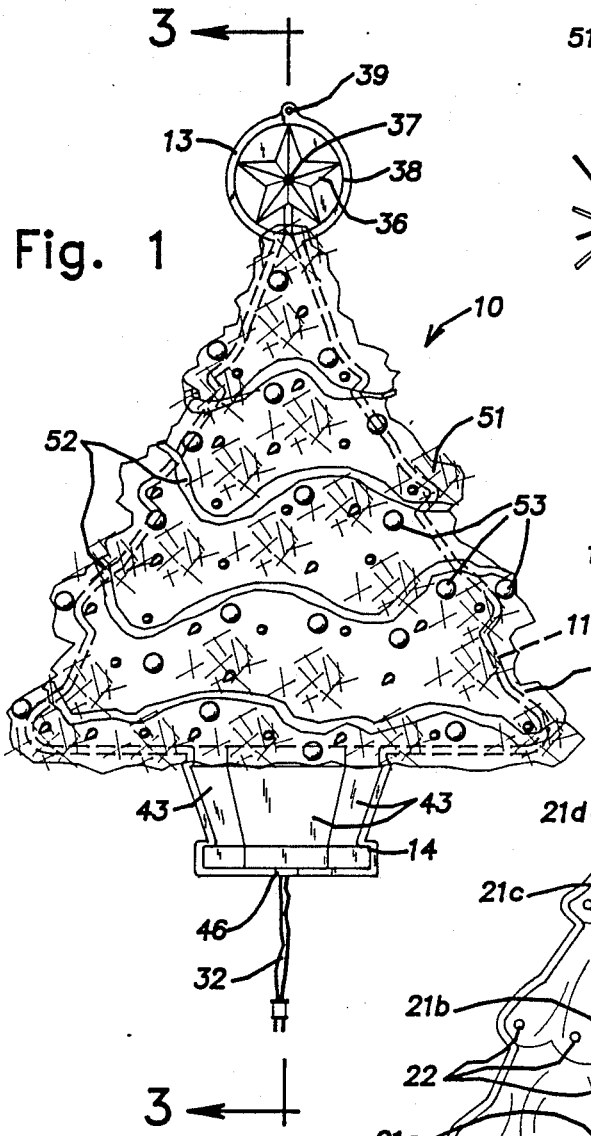
FIG. 1 is a front view of a decoration in accordance with this invention which simulates a decorated Christmas tree.

The illustrated embodiment of an ornament in accordance with the present invention is a decorated Christmas tree particularly suited for hanging on a wall surface. It should be understood, however, that in accordance with the broader aspects of this invention other ornamental shapes can be provided.

The basic structure of the Christmas tree ornament 10 is provided by a substantially rigid molded shell 11. In the illustrated embodiment, the shell 11 is molded from sheet plastic material by a vacuum molding process and provides a central simulated tree portion 12, an upper tree decoration portion 13 and a lower base portion 14. As best illustrated in FIG. 3, the shell provides a rearward peripheral edge flange 16 which extends along a plane so that when the ornament is installed as a wall hanging, the flange 16 extends along the plane of the wall on which the ornament is hung.

Figure 2:
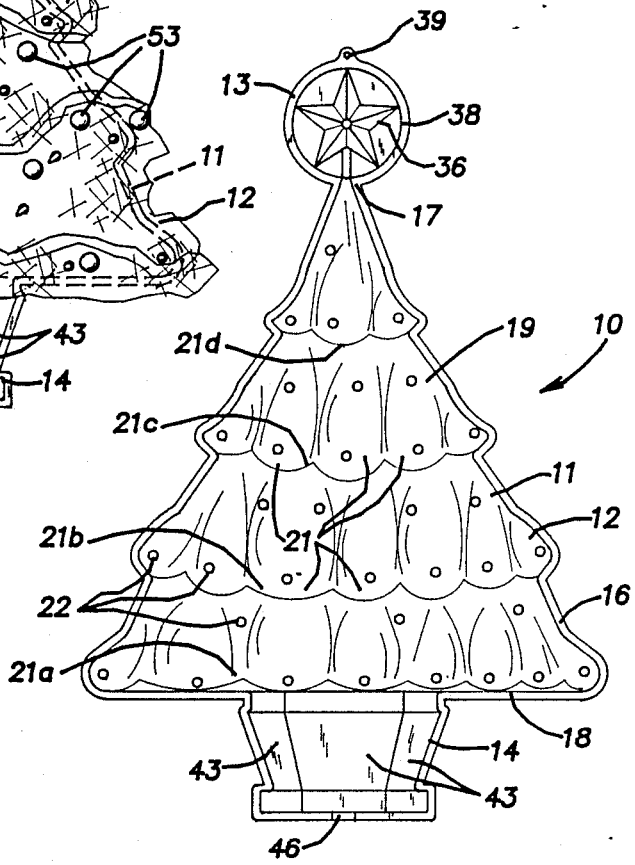
FIG. 2 is a back view of the decoration illustrated in FIG. 1 with the garland and lights removed to better illustrate the shape of the shell.

The tree portion 12 is generally concave and generally in the shape of one-half of a cone having an apex at 17 and a base at 18. Between the apex 17 and base 18, the shell provides an irregular, generally conical wall portion 19. However, within the wall portion 19 are a plurality of irregular forwardly facing projections 21. These projections give additional shape to the tree portion to better simulate the branches of a Christmas tree. The projections 21 tend to be arranged in horizontal rows **21*a*, 21*b*, 21*c* and 21*d*** as best illustrated in FIGS. 2 and 3. In addition to providing a better simulation of a tree configuration, the projection also provides additional strength to the shell. The projections need not all be of the same shape and size but preferably are generally tear shaped in configuration.

Located along the tree portion 12 are a plurality of openings 22 in which sockets 23 of a string of lights 24 are mounted. Preferably, the openings 22 provide generally cylindrical bores 26 which extend substantially perpendicular to the adjacent surface of the shell 11, as best illustrated in FIG. 4. These cylindrical bores 26 provide a substantial mounting area for the support of the sockets 23 of the string of lights. Preferably, the sockets are positioned so that the forward ends thereof are substantially flush with the forward ends of the cylindrical bores 26 and are adhesively secured within the bores to provide a permanent, strong connection. With this structure, sufficient strength is provided in the mounting of the sockets so that the sockets remain in position when the bulbs 27 are replaced.

The tree portion 12 provides a convex forward face 28 having a generally conical, irregular shape. The adjacent rearward face 29 is concave and defines a rearwardly facing cavity 31. The wire 32 of the string of lights 24 extends along the rearward cavity 31 and is concealed from view when the decoration is in use.

Although the illustrated embodiment provides a shell 11 which is vacuum molded from styrene material, the shell can be formed in other suitable ways, such as pressure molding, injection molding or rotational casting.

The decoration 13 illustrated represents a star 36 with a light bulb 37 at its center. The star is enclosed within a circular border 38 surrounded by the adjacent portion of the flange 16. Preferably, the flange 16 is provided with a top opening 39 through which a nail or wire can extend to hang the ornament.

The base 14 of FIGS. 1 through 4 simulates the shape of a hexagonal potting box which provides three generally planar wall portions 43. As best illustrated in FIG. 3, the bottom wall 44 of the base is provided with a centrally located, rearwardly facing recess 46 through which the wire 32 can extend without causing the flange to be spaced out from the adjacent wall surface.

Figure 1A:
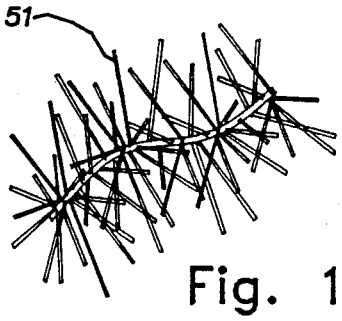
FIG. 1*a* is an enlarged fragmentary view of a portion of the pine needle-type garland used to cover the tree portion of the shell.

To provide a simulated tree structure, garland rope 51 (best illustrated in FIG. 1*a*) is mounted along the forward face 28 of the tree portion by adhesive or other suitable means so that it substantially fully covers the forward face 28 of the tree portion of the ornament. Such garland 51 simulates the needles of a Christmas tree and, by mounting the garland with sufficient density, the entire forward face 28 is virtually completely obscured from view. However, the irregular shape provided by the projections 21 causes the garland to assume an irregular profile which again simulates the appearance of a natural tree.

In order to add further decorations to the face of the tree portion of the decoration, relatively narrow garland rope 52 is also installed over the face of the garland 51. Preferably, the garland 51 and the garland 52 are of contrasting colors. For example, the garland 51 may be pine tree green and the contrasting garland 52 may be silver or white. With such contrasting colors, the appearance of a conventional decorated Christmas tree is closely approximated. In addition, the garland tends to surround the bulbs 27 and embed such bulbs to some extent so that the light emitted from the electric Christmas tree bulbs 27 is diffused by the garland and an impression of depth is obtained. Further, small spherical ornaments 53 are installed on a random basis along the surface of the tree portion of the ornament.

Generally, the string of lights is powered by typical house voltage; however, in some instances where a convenient supply of electrical power is not available, suitable batteries can be installed within the cavity 31 to provide the electricity to operate the bulbs 27.

Figure 5:
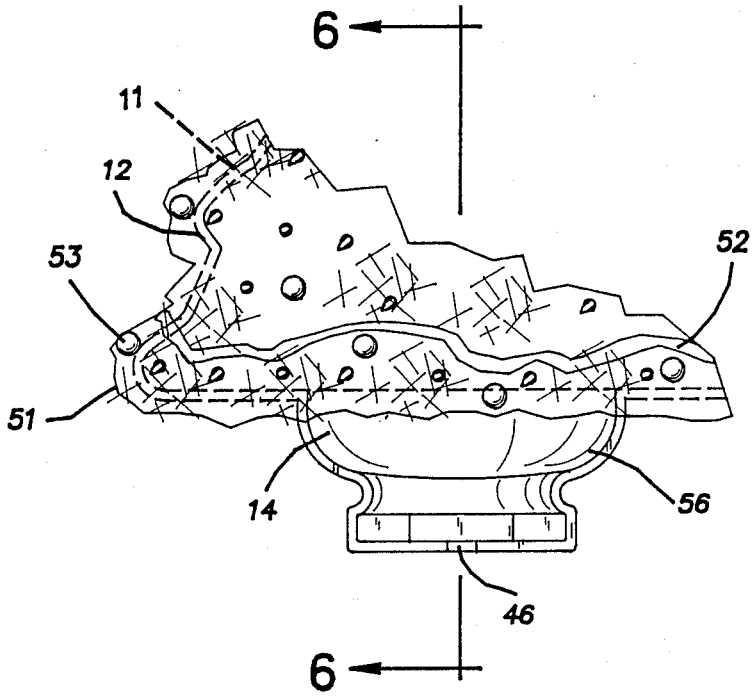
FIG. 5 is a fragmentary view of an alternate base construction.
Figure 6:
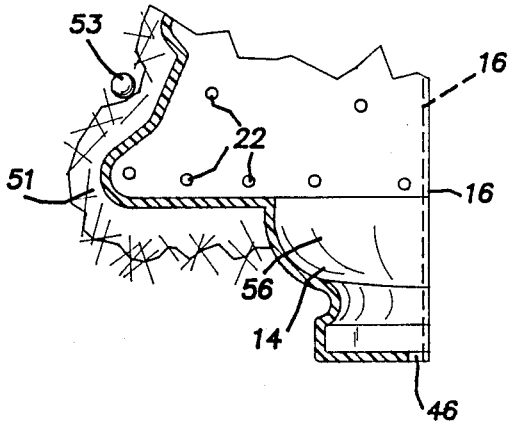
FIG. 6 is a fragmentary section taken along line 6—6 of FIG. 5 illustrating the alternate base structure.

FIGS. 5 and 6 illustrate a second embodiment in which the base provided by the shell is generally semicircular and simulates a ceramic pot 56. Here again, the base is integrally formed in the shell.

Generally, the shell is painted prior to the installation of the garland and lights. For example, the ornament 13 may be colored gold and the base may be red. If a green garland is to be installed on the tree portion 12, the surface of the tree portion of the shell is normally painted a dark green so that it does not show through the garland.

Figure 7:
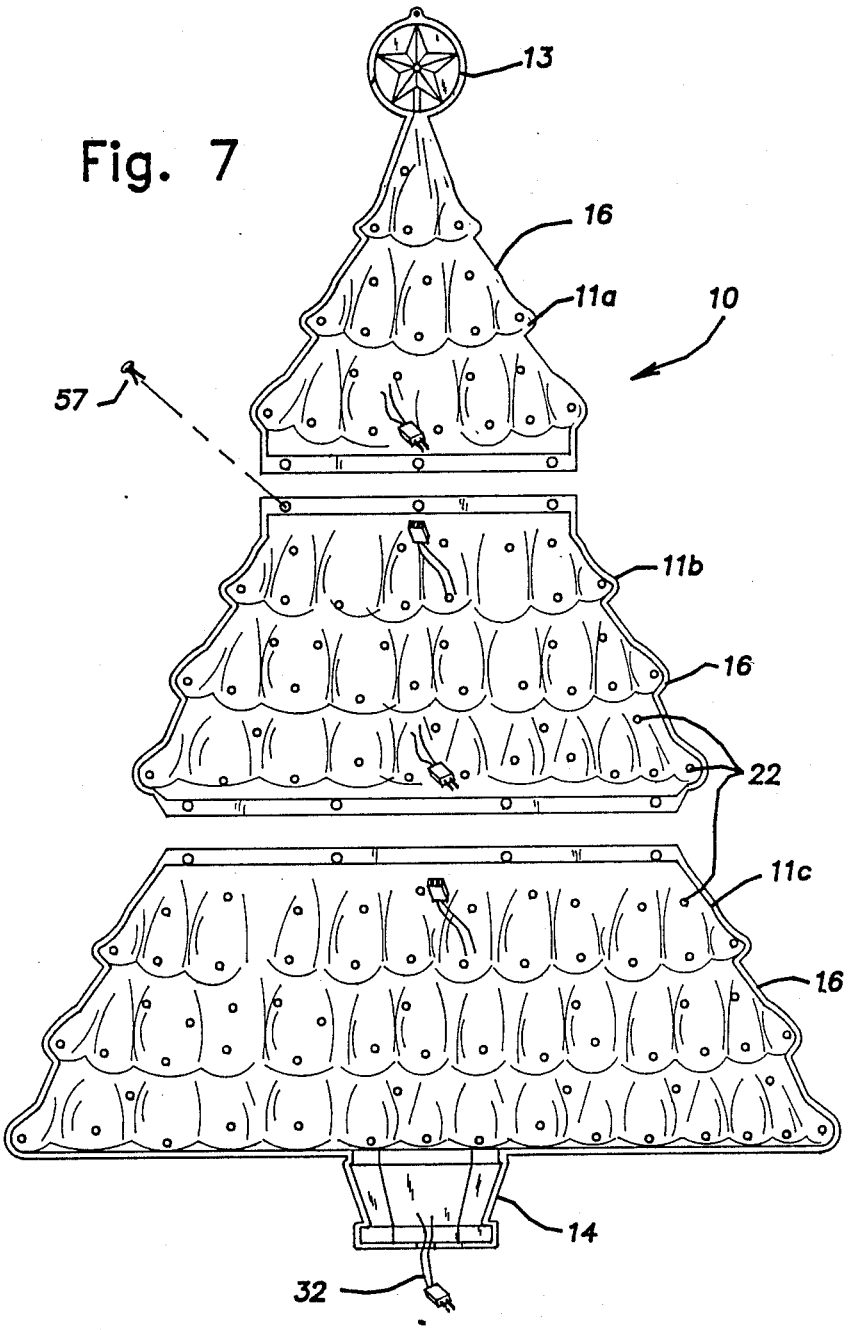
FIG. 7 illustrates an embodiment in which the decoration is formed in sections which are assembled for use.

The shell is formed so that opposed peripheral portions are not parallel but continue to diverge. Therefore, a number of ornaments can be compactly nested for shipping or storage, reducing the expensive thereof. Further, in instances in which a relatively large ornament is desired, the shell can be formed in separate sections 11*a*, 11*b* and 11*c* as illustrated in FIG. 7 and then connected by suitable fasteners 57. In such instances, it is desirable to install a single string of lights along each section and provide suitable plug and socket connections to permit the lights to be connected when the ornament is assembled for use.

Although the preferred embodiments of this invention have been shown and described, it should be understood that various modifications and rearrangements of the parts may be resorted to without departing from the scope of the invention as disclosed and claimed herein.

What is claimed is:

1. A decorative wall hanging comprising a rigid, molded shell formed of thin moldable material, said shell being structured to provide a substantially continuous forward face generally in the shape of a Christmas tree having an upper ornament and a lower base, said shell providing a substantially continuous rearward concave face defining a rear cavity portion, a plurality of openings in said shell extending from said back face to said front face, and a string of electric lights in said cavity providing light sockets in said openings and light bulbs projecting from said openings beyond said front face.

2. A decorative wall hanging as set forth in claim 1, wherein garland is mounted on said front face at least partially covering said light bulbs and operating to diffuse light emitted from said light bulbs, said garland simulating needles of a pine tree.

3. A decorative wall hanging as set forth in claim 2, wherein said shell provides a cylindrical bore at said openings providing area contact and support for said sockets.

4. A decorative wall hanging as set forth in claim 3, wherein said sockets are secured in said cylindrical bore with adhesive and are securely mounted in said shell so that bulbs can be replaced without damaging the mounting of said sockets in said openings.

5. A decorative wall hanging as set forth in claim 1, wherein said shell provides a peripheral flange extending along a plane, said peripheral flange being engageable with a planar wall surface when said decoration is mounted thereon.

6. A decorative wall hanging as set forth in claim 5, wherein said shell provides a recess along the rearward lower wall portion of said base through which the cord of said string of lights extends.

7. A wall decoration comprising a substantially rigid shell of molded plastic material having a substantially uniform thickness, said shell providing a substantially continuous convex front face and a substantially continuous concave rear face defining at least part of a cavity, said shell having a substantially planar peripheral edge, and providing a plurality of cylindrical bores extending substantially perpendicular to the adjacent portions of said shell, said bores providing an opening through said shell, a string of lights providing sockets mounted in associated bores, light bulbs extending beyond said forward face, and wire in said cavity connecting said sockets.

8. A wall decoration as set forth in claim 7, wherein said shell provides the shape of a Christmas tree, and simulated pine garland is mounted on said front face to provide a simulated Christmas tree decorated with lights.

9. A wall decoration as set forth in claim 7, wherein additional garland of contrasting color is positioned over said pine garland, and Christmas tree ornaments are mounted on said shell at random locations along said front face.

* * * * *